United States Patent [19]

Henry, IV et al.

[11] 4,371,310

[45] Feb. 1, 1983

[54] CENTRIFUGAL PUMP RECIRCULATION DIFFUSER

[75] Inventors: John W. Henry, IV; David E. Cassel, both of Annapolis, Md.

[73] Assignee: The United States of America as represented by the Secretary of the Navy, Washington, D.C.

[21] Appl. No.: 492,300

[22] Filed: Jul. 23, 1974

[51] Int. Cl.[3] ..... F04D 29/66

[52] U.S. Cl. ..... 415/211; 415/119

[58] Field of Search ..... 415/119, 11, 209, 204, 415/211

[56] References Cited

U.S. PATENT DOCUMENTS 2,360,145 10/1944 Lansing ..... 415/209

3,381,621 5/1968 Luhmann et al. ..... 415/204

*Primary Examiner*—Stephen C. Bentley

*Attorney, Agent, or Firm*—R. F. Beers; L. A. Marsh

[57] ABSTRACT

A recirculation diffuser for centrifugal pumps that produces a continuously-rising head capacity curve and at the same time reduces levels of impeller vane-frequency sound and other high level acoustic flow tones. The conventional vane diffuser in the pump casing at the periphery of the rotary impeller is modified by separating one of the side shrouds from the diffuser vanes thereby creating a recirculation flow path around the vanes from the outside high pressure to the inside low pressure side.

4 Claims, 2 Drawing Figures

CENTRIFUGAL PUMP RECIRCULATION DIFFUSER

The invention described herein may be manufactured and used by or for the Government of the United States of America for governmental purposes without the payment of any royalties thereon or therefor.

BACKGROUND OF THE INVENTION

The instant invention relates generally to centrifugal pumps and more particularly to pump diffuser means having recirculation around the diffuser vanes.

One of the Navy's major concerns in the design of its numerous types of ships and submarines is the reduction of radiated noise during operation to avoid detection by the enemy. It is known that centrifugal pump tonal noise contributes significantly to the radiated noise signature of the Navy's ships and submarines.

While the design of quiet impellers for single-stage volute pumps is well established and used, a significantly more complex area of pump quieting technology is involved in multistage diffuser-type pump design. A multistage diffuser-type pump is characterized by its producing several impeller and diffuser vane-related tones rather than the single, vane frequency typical of the single-volute pumps.

Conventional multistage diffuser-type pumps have a vaned impeller and a plurality of diffuser vanes at the periphery of the impeller for directing the flow of fluid to the next stage. The diffuser vanes fit tightly between the parallel shrouds of the pump casing. This design results in a pump head-capacity curve which may droop close to and at flow shutoff. Another problem with this design is that pure-tone sounds are generated at the impeller vane passage frequency and at other frequencies not multiples of pump rotation.

It is desirable to design a centrifugal pump having a continuously rising head-capacity curve, (i.e. without droop near flow shut off) so as to be capable of stable parallel operation with another pump, and to have minimum vane-related tonal sound levels.

SUMMARY OF THE INVENTION

Accordingly, an object of the instant invention is to provide a new and improved diffuser type centrifugal pump.

Another object of the present invention is to provide a multistage, diffuser type centrifugal pump having a continuously rising head-capacity curve to shutoff.

Still another object of the present invention is to provide a centrifugal diffuser type pump having reduced levels of impeller vane-frequency sound and other high level acoustic flow tones.

A further object of the instant invention is to provide a centrifugal pump having a recirculation diffuser.

Briefly, these and other objects of the instant invention are attained by the use of a recirculation diffuser which permits recirculation flow around the diffuser vanes from the outside high pressure area to the inside low pressure area. The vanes are supported by the casing shroud on one side, and a gap separates the edges of the vanes from the shroud on the other side, thus providing a diffuser recirculation path for the pumped liquid.

Why diffuser recirculation works is not entirely understood, but apparently, providing the recirculation path, changes the hydrodynamic flow regime in the annulus between the impeller and the inner edges of the diffuser vanes enough that the objectionable flow-tone-producing mechanism is upset. It is known from experience that the greater the fluid wake mixing between the impeller exit and the diffuser entrance, the lower the vane noise level. Greater mixing is usually achieved by designing a larger radial clearance between the impeller and diffuser but this results in lower pump efficiency. With a recirculation diffuser, the small amount of flow returned to the mixing space tends to increase mixing and so smooths the impeller vane wakes and thus reduces vane frequency pulsations without excessive loss in efficiency.

Regarding the rising head capacity curve feature attained, it is well known that an external recirculation line on centrifugal pump system can extract from a drooping pump characteristic curve that portion which is continuously rising, but only at the expense of wasting all the energy of the recirculated flow.

The recirculation diffuser of the instant invention achieves the rising head characteristic in the same manner, but with less than half the energy loss of the external recirculation scheme. This is because assuming that the recirculation flow rate is the same in both external and diffuser recirculation, less than half the pump's total developed pressure is generated by the diffuser. It is only a portion of the pressure developed by the diffuser that is lost in diffuser recirculation flow, and obviously, no pressure is lost that was produced in the impeller, per se.

BRIEF DESCRIPTION OF THE DRAWINGS

A more complete understanding of the invention and many of the attendant advantages thereof will be readily appreciated as the same become better understood by reference to the following detailed description when considered in connection with the accompanying drawing wherein.

DESCRIPTION OF THE PREFERRED EMBODIMENT

Figure 2:
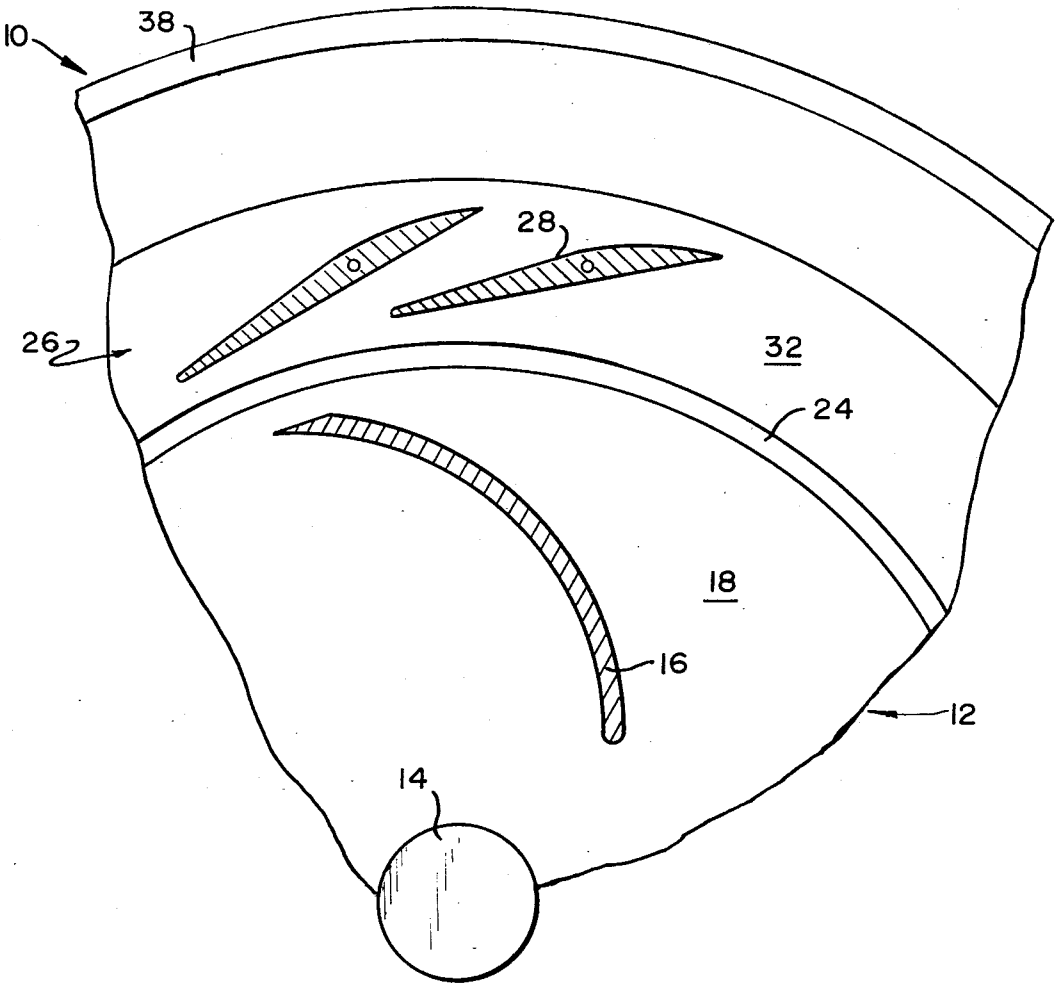
FIG. 2 is a partial sectional view taken at right angles along the section line 2—2 of FIG. 1.
Figure 1:
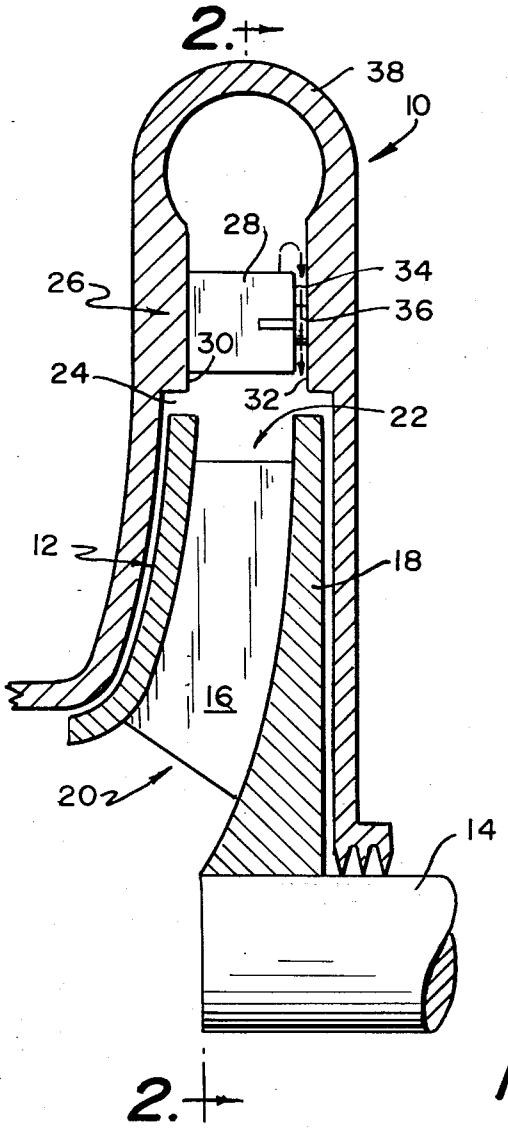
FIG. 1 is a partial sectional view in elevation taken through the impeller and diffuser area.

Referring now to the drawings, wherein like reference numerals designate corresponding views throughout the several views, there is shown generally in FIG. 1 a stage of a centrifugal pump 10, which may be a stage of a multistage pump. The pump has an impeller 12 mounted on a rotatable shaft 14 journaled in a pump casing (not shown). The impeller has a plurality of curved and hydrodynamically shaped vanes, 16 which are conventionally integral with the impeller 12. Vanes 16 are between side flanges 18 forming a closed centrifugal flow path for the fluid from the inlet 20 to the outlet 22 at the periphery, as shown by the arrows.

Radially outward from the impeller outlet 22 is a space or annulus 24, separating the impeller 12 from a diffuser section 26. The diffuser section 26 comprises a plurality of diffuser vanes 28 attached along one edge to one of the casing shrouds 30 and spaced a distance of 20 to 40 mils from an other casing shroud 32. A gap 34 is therefore formed between the vanes 28 and the casing shroud 32, and may be maintained by the head of a thumbtack-shaped spacer 36 which is retained in a bore in the vanes 28. Radially outward from the diffuser section 26 is a collector 38 wherein the liquid is collected and exhausted at an elevated pressure.

In operation the liquid to be pumped is admitted into the pump suction near the impeller shaft 14 at the center of the pump casing. Here the liquid is conducted to the inlet 20 of the centrifugal impeller 12 and thrown outwardly by centrifugal force induced by the rotating impeller, past the impeller vanes 16. The liquid exits the periphery of the impeller at high velocity into the annulus 24 that forms a mixing space between the impeller and the diffuser section 26. The liquid continues by centrifugal force to flow into the diffuser 26 past the diffuser vanes 28 where the flow is straightened and the velocity converted to pressure increase, and thence into the collector 38 at high pressure. In the diffuser section 26 a portion of the flow recirculates back around the diffuser vanes 28 via the gap 34 (see dashed arrows) which creates a flow path from the outside high pressure to the inside low pressure.

While the mechanism is not completely understood, the recirculation flow mixes in the annulus with the main flow from the impeller to upset the even flow which induces the objectional flow tones. Also the recirculation flow, as in external recirculation, creates a rising head capacity curve. These novel features are discussed in detail hereinbefore in regard to the summary of the invention.

Obviously many modifications and variations of the present invention are possible in light of the above teachings. It is therefore to be understood that within the scope of the appended claims, the invention may be practiced otherwise than as specifically described.

What is claimed is:

1. A centrifugal pump for liquids having a casing with a vaned impeller rotatably mounted therein and a diffuser section at the periphery thereof comprising:

a pair of facing shroud members forming the diffuser section of the casing;

a plurality of hydrodynamically shaped diffuser vanes attached to at least one of said shrouds; and a recirculation flow path around said diffuser vanes from the outside high pressure side to the inside low pressure side of said diffuser vanes.

2. The centrifugal pump of claim 1 wherein:

one of said shroud members is separated from the edges of said plurality of diffuser vanes to form a gap between the shroud and the diffuser vane thus providing a recirculation flow path.

3. The centrifugal pump of claim 2 further comprising:

spacers between the edges of said plurality of said plurality of diffuser vanes and said shroud members.

4. The centrifugal pump of claim 3 wherein:

said spacers are thumbtack shaped, the head of which is 20 to 40 mils thick.

* * * * *